US006640912B2

(12) United States Patent
Reddoch

(10) Patent No.: US 6,640,912 B2
(45) Date of Patent: Nov. 4, 2003

(54) CUTTINGS INJECTION SYSTEM AND METHOD

(75) Inventor: Jeffrey Reddoch, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 4 days.

(21) Appl. No.: 09/994,522

(22) Filed: Nov. 26, 2001

(65) Prior Publication Data

US 2002/0033278 A1 Mar. 21, 2002

Related U.S. Application Data

(63) Continuation-in-part of application No. 09/461,604, filed on Jan. 20, 1998, now Pat. No. 6,321,860.

(51) Int. Cl.[7] ..... E21B 21/01; E21B 21/06

(52) U.S. Cl. ..... 175/217; 166/275; 166/308; 166/75.15; 166/75.12; 364/528.2; 364/528.36; 364/528.39; 364/528.4

(58) Field of Search ..... 175/66, 206, 207, 175/57, 24, 217, 424; 166/335, 276.1, 271, 275, 308, 75.15, 75.12; 405/128; 364/528, 528.1, 528.2, 528.36, 528.39, 528.4

(56) References Cited

U.S. PATENT DOCUMENTS 5,085,277 A * 2/1992 Hopper
5,518,996 A * 5/1996 Maroy et al.
6,321,860 B1 * 11/2001 Reddoch

* cited by examiner

*Primary Examiner*—Roger Schoeppel
(74) *Attorney, Agent, or Firm*—Madan, Mossman & Sriram, P.C.

(57) ABSTRACT

An automated high speed drill cuttings processing and injection module having a relatively small foot print, capable of operation in zone one hazardous environments, for injecting drill cuttings into an earth formation, capable of handling high drilling rate cuttings surges. The process including conveying systems, holding and slurry tanks, circulating pumps, high speed grinding mill, high pressure injection pump, fragmentation system and automation system for controlling electrically driven injection pump having automatic speed control regulation with torque and horsepower limiting features. Thereby allowing high-speed injection without plugging the formation while still allowing for high-pressure formation fracturing when necessary. The processing system further insures cuttings slurry homogenization and entrained particle size to less than 100 micron for both hard and soft particles. The system reduces installation cost dramatically. An onboard computer system further provides continuous automatic control, measures and records continually the dry weight of cuttings removed from the hole and controls, slurry density and viscosity, as well monitoring and maintaining injection pressure to within established high and low pressure parameters.

31 Claims, 16 Drawing Sheets

CUTTINGS INJECTION SYSTEM AND METHOD

This is a continuation-in part of my previous application Ser. No. 09/461,604 filed Jan. 20, 1998 now U.S. Pat. No. 6,321,860 issued Nov. 27, 2001 and incorporated herein by reference.

BACKGROUND OF THE INVENTION

1. Field of the Invention

This invention relates to the collection and processing of drill cuttings separated from a drilling rig's solids control system and more particular to the processing and injections of such cuttings into fractures in the earth formation adjacent the well being drilled via the annulus between a well casing and well bore or into other such cuttings disposal scenarios.

2. General Background

In the oil and gas drilling industry the processing of drill cuttings and their disposal has been a logistics and environmental problem for a number of years. Various systems have been developed for handling and processing the cuttings for disposal and reclamation. Such systems include returning the cuttings via injection under high pressure back into the earth formation in a manner such as that described in U.S. Pat. Nos. 4,942,929, 5,129,469 and 5,109,933, and the treatment of drill cuttings as disclosed by U.S. Pat. Nos. 4,595,422 5,129,468, 5,361,998 and 5,303,786. However, in practice, the injection process is not as simple as it may seem. The preparation of the cuttings into a homogeneous mix, which is acceptable to high-pressure pumps used in pumping material down a well, is essential. Transforming the cuttings into a pumpable slurry is complicated by variable drill rates producing large volumes of cuttings at times thereby creating surges in drill waste materials, the need to pump the slurry at high pressures into the earth and/or formation fractures hundreds if not thousands of feet below the surface. Complications also arise due to the need for constant velocity varable density and viscosity and high horsepower while pumping. On offshore platforms space is always at a premium. Therefore, cuttings treatment units must be compact and as light in weight as possible. Solids control equipment is most often placed in hazardous areas, near the well bore, where large horsepower internal combustion engines are not permitted due to the possibility of high gas concentration. Therefore, any additional equipment used for processing solids must meet stringent explosion proof requirements for such areas of the rig. Therefore, large high horsepower engines and pumping units are generally spaced some distance from the primary solids control equipment such as the shaker screens and fluid recovery and particle grinding and injection pumping systems.

Heretofore, cuttings injection has not gained wide acceptance in offshore drilling operations such as may be found in the North Sea, primarily due to the problems discussed above and the inefficiency and ineffectiveness of the cuttings preparation and injection processes.

Although, other cuttings processing system have been developed for preparing drill cutting for disposal and some have been tried in an attempt to inject such processed drill cuttings into a well bore, as is disclosed by U.S. Pat. Nos. 4,942,929, 5,129,469, and 5,109,933 and 5,431,236. However, none combine, individually or collectively all of the advanced features, required for problem-free cuttings injection, disclosed herein by the instant invention.

The problems associated with cuttings injection are numerous as expressed by Warren in U.S. Pat. No. 5,431, 236. Starting with processing of the cuttings for injection, we find that the particles are not uniform in size and density making the slurification process very complicated. The cuttings mixture often plugs circulating pumps, the abrasiveness of the cuttings also abrade the pump impellers causing cracking, some attempts have been made to use the circulating pumps for grinding the injection particles by purposely causing pump cavitations, thereby shortening pump life, hard cakes build up in tanks creating circulation problems and circulation pumps cavitate unexpectedly due to irregular particle size. Therefore, it is known that a uniform particle size of less than 100 micron must be maintained for proper formation injection at the well site. Maintaining such consistency with hard and soft materials is very difficult. The use of shear guns to reduce particle size as taught by Warren does not insure consistency and requires continuous recalibration thereby reducing the volume capacity of the processor. Warren also teaches that sand should be separated through the use of hydro cyclones, which further reduces throughput volume.

Next we find that since no two earth formations are alike it is very difficult to prevent plugging of the formation fractures in the well bore especially when there are long delays in placement of the injection slurry in the formation. Plugging of the formation fractures often occurs as a direct result of large or irregular particle size, often in the range of 300 micron or greater, combined with high-pressure high volume applications. Plugging of the well formation results in extensive well drilling downtime, which is very expensive due to the rigs inability to dispose of its cuttings. Cuttings injection failures have occurred primarily due to the inability to, handle large volumes of cuttings surges, fine tune the injection process by providing particle size, control uniform slurry density and to provide volume and pressure, density and viscosity control over the injection process. Further, attempts to inject cutting slurries into the earth formation have met with failure as a result of the inability to manually control all facets of the process and injection operation. As a result of such failures most offshore drilling operators in the North Sea have banned the practice and have resorted to using other expensive disposal methods.

It is to this end that the present invention has been developed, the proprietary know-how of which has been maintained until disclosed herein thereby, disclosing a unique efficient system and method for injecting drill cuttings into an offshore oil and gas well in a drilling environment requiring compactness, relatively light weight, low maintenance, full automation and operability in hazardous potentially explosive environments.

SUMMARY OF THE INVENTION

The instant invention has overcome the problems of the prior art and has proven itself by successfully performing cuttings processing and injection in wells where others have failed under identical conditions. The instant invention relates to a drill cuttings processing and injection system for use in hazardous oil and gas well drilling environments where compactness, smooth high performance injection pumping which provides zero downtime and volume variability, and where reduced maintenance are essential. In accordance, a series of improved modular processing systems are provided comprising a shaker package, a dryer, a grinder and/or roll mill package, a slurrification control package, Slurrification tank, transfer package, injection pump package, air control system, cuttings weighing and chemical proportioning system, hydraulics package, and electrical package including computer automated control system. The cuttings control system transfers drill cuttings from the drilling rig's cuttings shaker discharge trough optionally by any of several conveying or transfer methods used within the art to the injections system for processing where the cuttings are striped of any residual drilling fluids and died and weighed prior to being fine ground into controlled particle sizes. The weight of the dried cuttings are then compared to the drilling rate downhole thereby providing cuttings disposal flow data. The dried cuttings may then enter the slurrification package where the cuttings are further processed for injection by controlling the viscosity and density of the slurry based on the cuttings injection pressure feedback, via a high pressure pump, from deep into the earth's formation. These and other aspects of the present invention together with certain advantages and superior features and improvements will be further appreciated by those skilled in the art upon reading the following detailed description of these new embodiments and processes.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
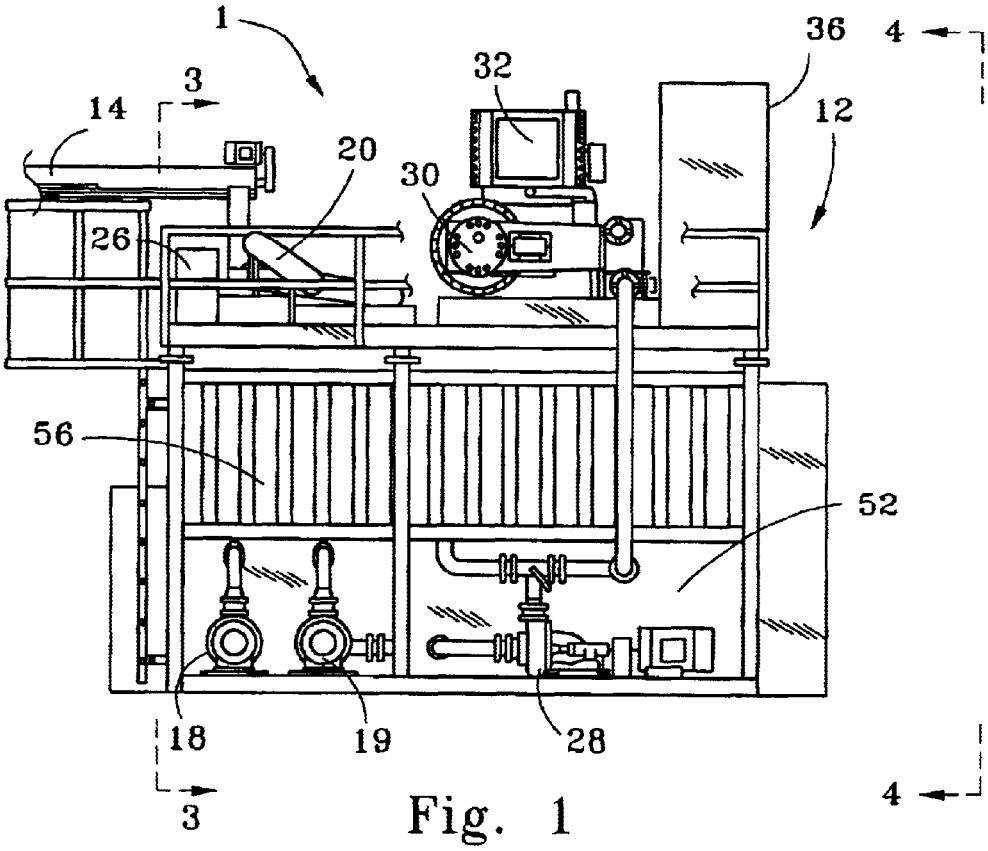
FIG. 1 is a front elevation of the process module for an improved embodiment 1.
Figure 2:
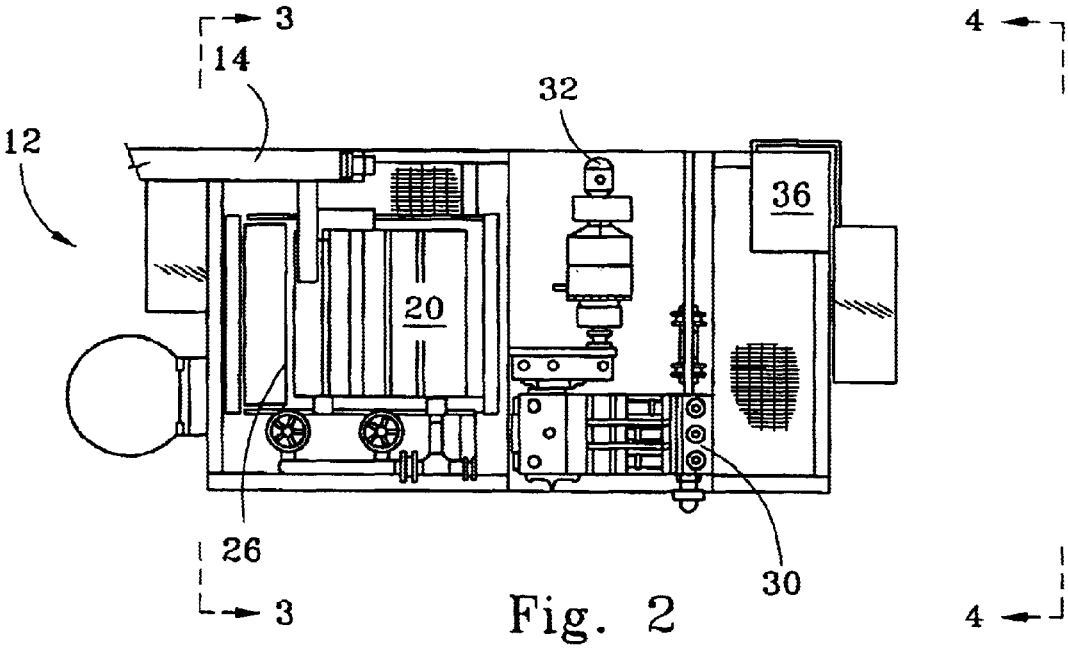
FIG. 2 is top view of the process module for improved embodiment 1.
Figure 4:
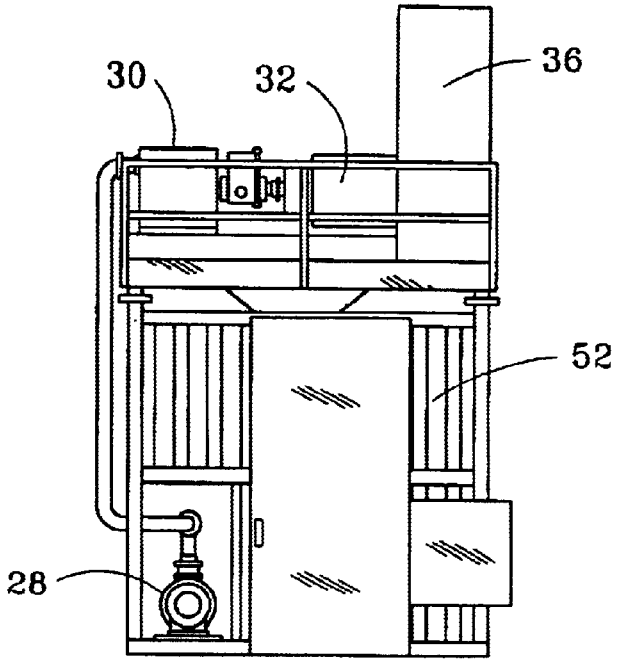
FIG. 4 is a right side elevation view of the process module for improved embodiment 1 as seen along sight line 4—4 in FIG. 1.
Figure 3:
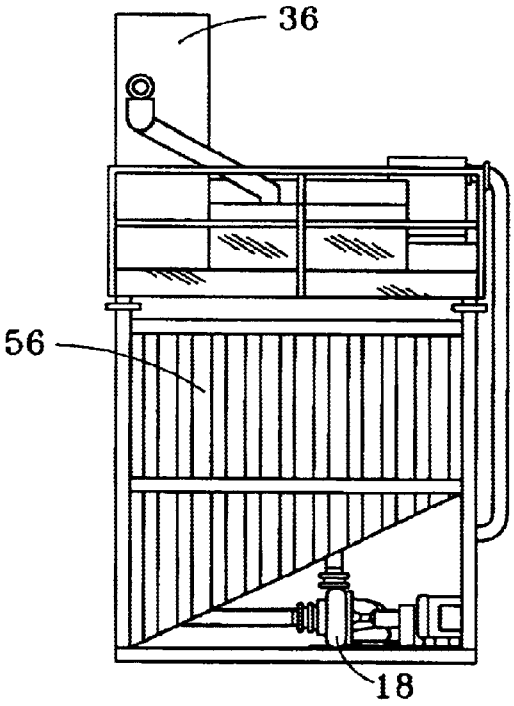
FIG. 3 is a left side elevation view of the process module for improved embodiment 1 as seen along sight line 3—3 in FIG. 1.
Figure 5:
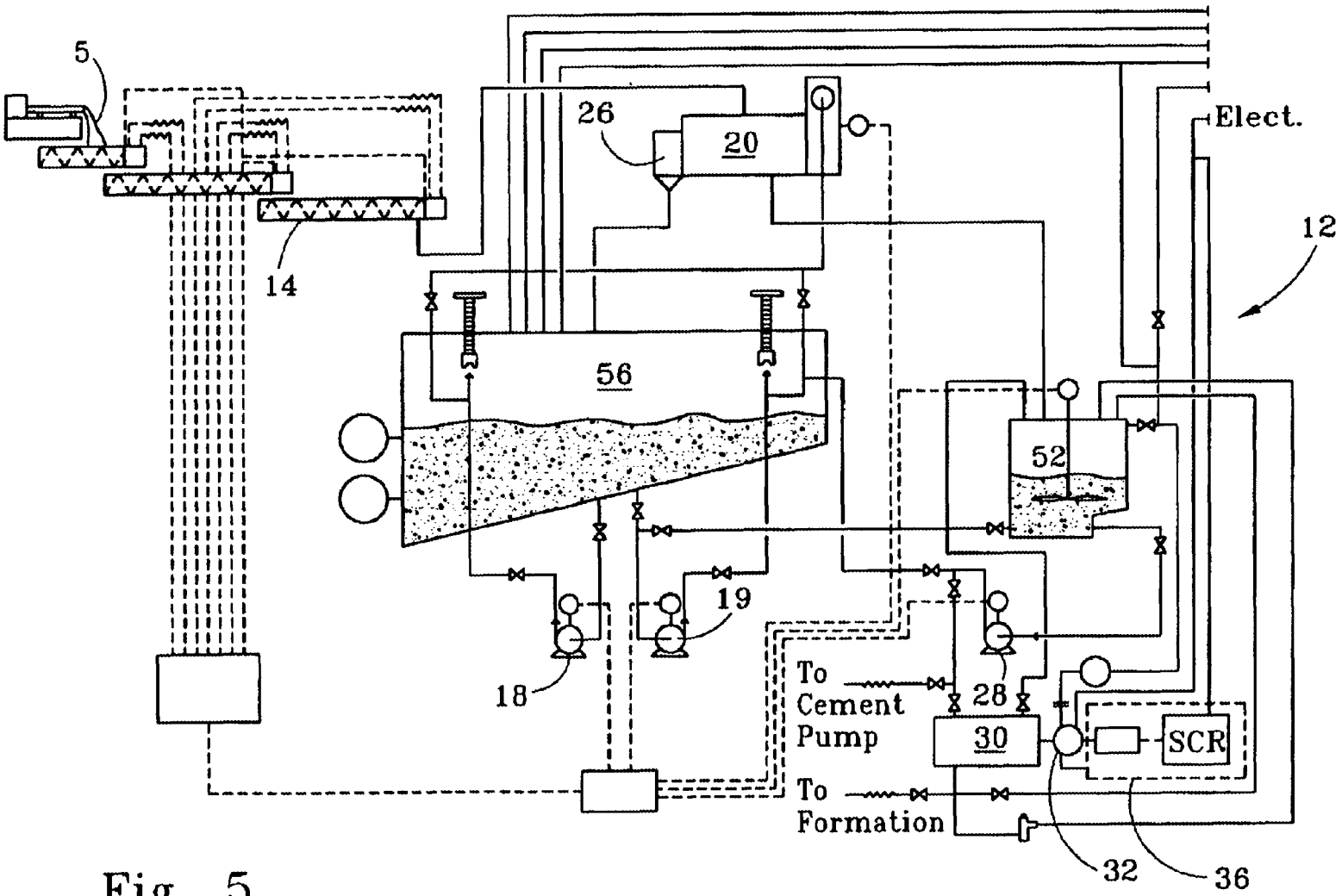
FIG. 5 is a schematic diagram of the process system for embodiment 1.

Turning first to FIG. 1 we see the improved cuttings injection processing system comprises a newly configured processing module 12 which, when assembled, is self contained and fully operational for operation on an offshore drilling location. In this improved embodiment 1 the module 12 also comprises an in-feed cuttings conveyor 14 or other such transfer means, which feed, overflow drill cuttings from a drilling rig's drilling fluid mud recovery system's shell shakers to the process module 12 in much the same manner a previously taught. However, in this embodiment the cuttings are further sized and processed in a single slurry processing tank 56. The slurry tank 56 and its adjacent circulating tank 52 are configured with special baffles and a conical lower portion to prevent plugging and caking of the solids and increase the speed in which the cuttings in slurry are feed to the grinder pumps 18,19. As in the earlier models the cuttings slurry is agitated and ground by the centrifugal shredding or the grinding pumps 18, 19 located below and adjacent to the slurry tank 56 as best seen in FIGS. 3 and 4 where water is added as necessary to provide a pumpable slurry solution. In this new embodiment the slurry is then pumped via either of the two grinding pumps 18,19 to the system shale shaker 20 now located above the slurry tanks 56 where the slurry passing through the shale shaker's screens is fed back into the single slurry tank 56, where the cuttings are further sized by impingement or directed to the holding tank 52 as previously taught. Overflow cuttings, entrained cuttings which do not pass through the screens of the shale shaker 20, are gravity fed to a roll mill 26 where oversize cuttings, such as large chunks of sandstone, limestone and shale are instantaneously ground into fine particles and fed back to the slurry tank 56. This high speed milling operation performed by roll mill 26 serves to significantly reduce particle size to a uniform consistence, thus reducing the possibility of restricted flow rates caused by irregular size particles entrained in the slurry during the cutting's first pass through the slurry tank. A third pump 28 is provided for circulating slurry between the holding tank 52 and the slurry tank 56. Second grinding pump 19 may also serve as backup for the first grinding pump 18. Conductive lines are provided for feeding the homogenous slurry, resulting from thorough mixing and slurry particle reduction, to the high pressure injection pump 30, now located above the holding tank 52, for injection into the annulus of a well bore and ultimately into the earth formation as previously taught. As seen in FIGS. 1 and 4 the new embodiment places the shaker 20 and the mill 26 as well as the injection package consisting of elements 30–36 above the tanks 52 and 56, thereby reducing the foot print of the injection package 12. As seen in FIG. 5 the improved injection module 12 basically functions the same as previously disclosed but in a more efficient manner with the elimination of a second slurry tank.

As previously disclosed a special electrical AC/DC "Speed Control Regulator" (SCR) package 36 is provided for controlling the large, electrical motor driving the high-pressure triplex or piston type injector pump 30. The SCR system 36 is ideally suited to this particular operation due to its ability to control a wide range of motor speeds, adjustable torque control, excellent speed regulation, dynamic braking, fast, stable response to changing load conditions encountered in deep well pumping operations, horsepower limiting, pressure limiting on well cuttings injection, high efficiency and automatic operation.

As previously explained in our earlier application automated electrical speed control and pressure controls allow other control systems to be implemented, which may be computerized to assist in automating and controlling the injection process system. Therefore, it is possible to fully automate the injection process based on formation reaction information. Such a system has many advantages, for example, automation of the system's injector pump speed and torque also prevents formation plugging and is interlocked to protect the well from over pressurization. The systems may also be run at very low speed and low pressure thereby preventing large formation fractures. However, when the need arises high pressure and high horsepower can be applied to fracture the formation.

It is also important to have the ability to leave the slurry in the formation for long periods without plugging the formation or the casing annulus. Therefore, a process has been developed and included into the system for automatically injecting premixed gels having yield strength and fluid loss properties into the slurry solution thereby allowing for formation sensitivity. Such automatic injection may be programmed to a predetermined rate based on formation requirements or to meet real time changing conditions. Automation further allows computer control of multiple processes thereby drastically reducing or eliminating the need for excessive manning of the system on a constant basis, thus reducing cost of operation.

Since it is highly desirable to reduce the entrained particle size to less than 100 micron and further maintain both density and viscosity in order to insure long-term success of cuttings injection and significantly increase the cuttings volume the formation will receive, it seems obvious that the smaller the particles size the less plugging and fracturing occurs in the earth formation. Therefore, an important feature of the injection process module 12 regardless of its configuration is its ability to size and fragment cuttings particles and thereby preventing constipation of the drill cuttings well injection processing system. This feature helps prevents shutdowns of drilling operations due to cuttings out flow plugging. It is also important for the driller to know if the cuttings at the bottom of the well bore are reaching the surface and are being disposed of as fast as they are being produced and not banking-up in the casing. To accomplish this it has been found that it is beneficial to reduce the cuttings to a dry state thereby, eliminating drilling fluids and residual petrochemicals from the equation. Reducing the cuttings to a dry state further reduces the bulk storage capacity required, makes transport easier and more cost effective when necessary while still allowing the dry cuttings to be converted to a slurry when desired for injection.

Figure 6:
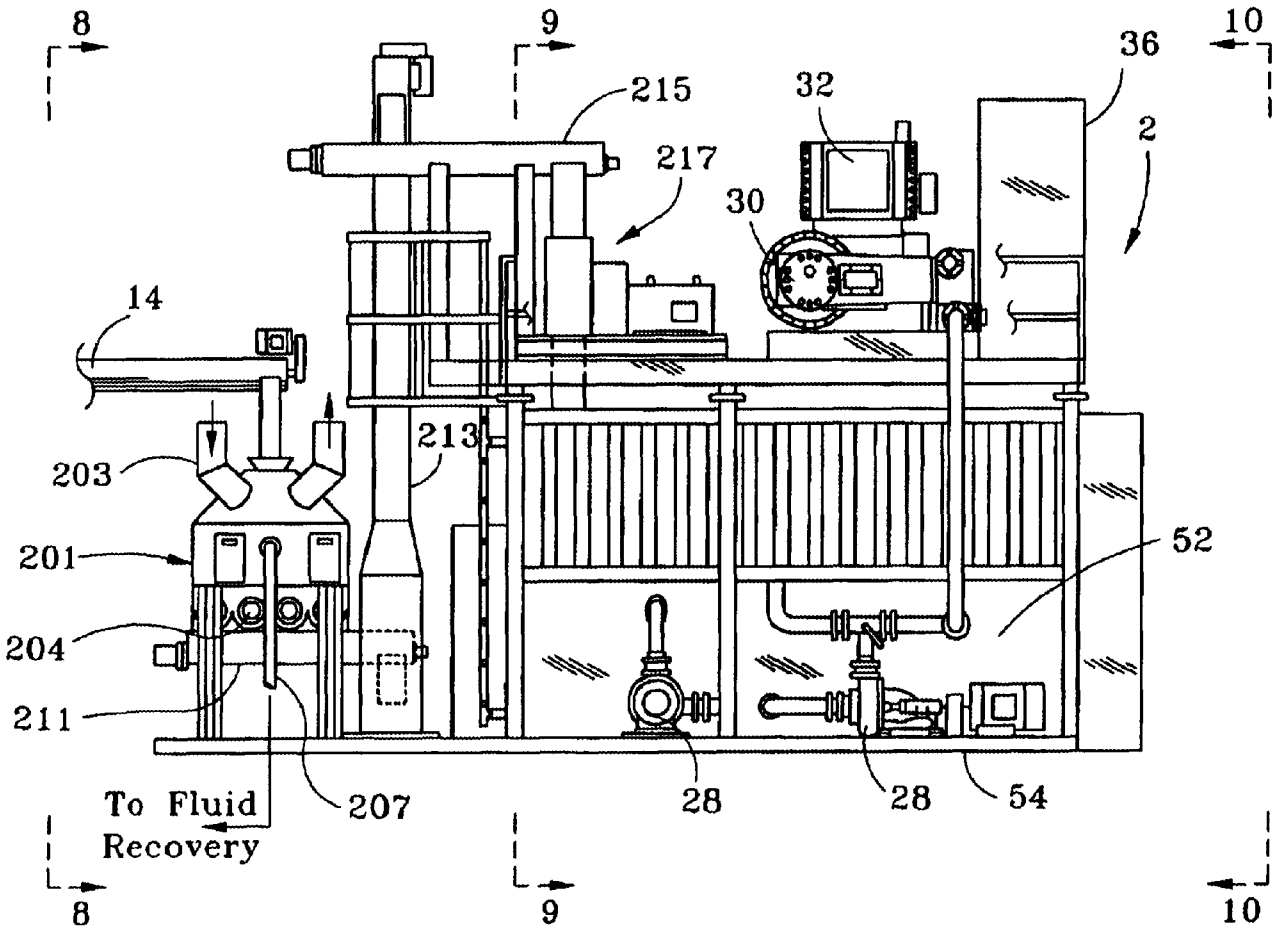
FIG. 6 is a front elevation view of the process module for improved embodiment 2.
Figure 7:
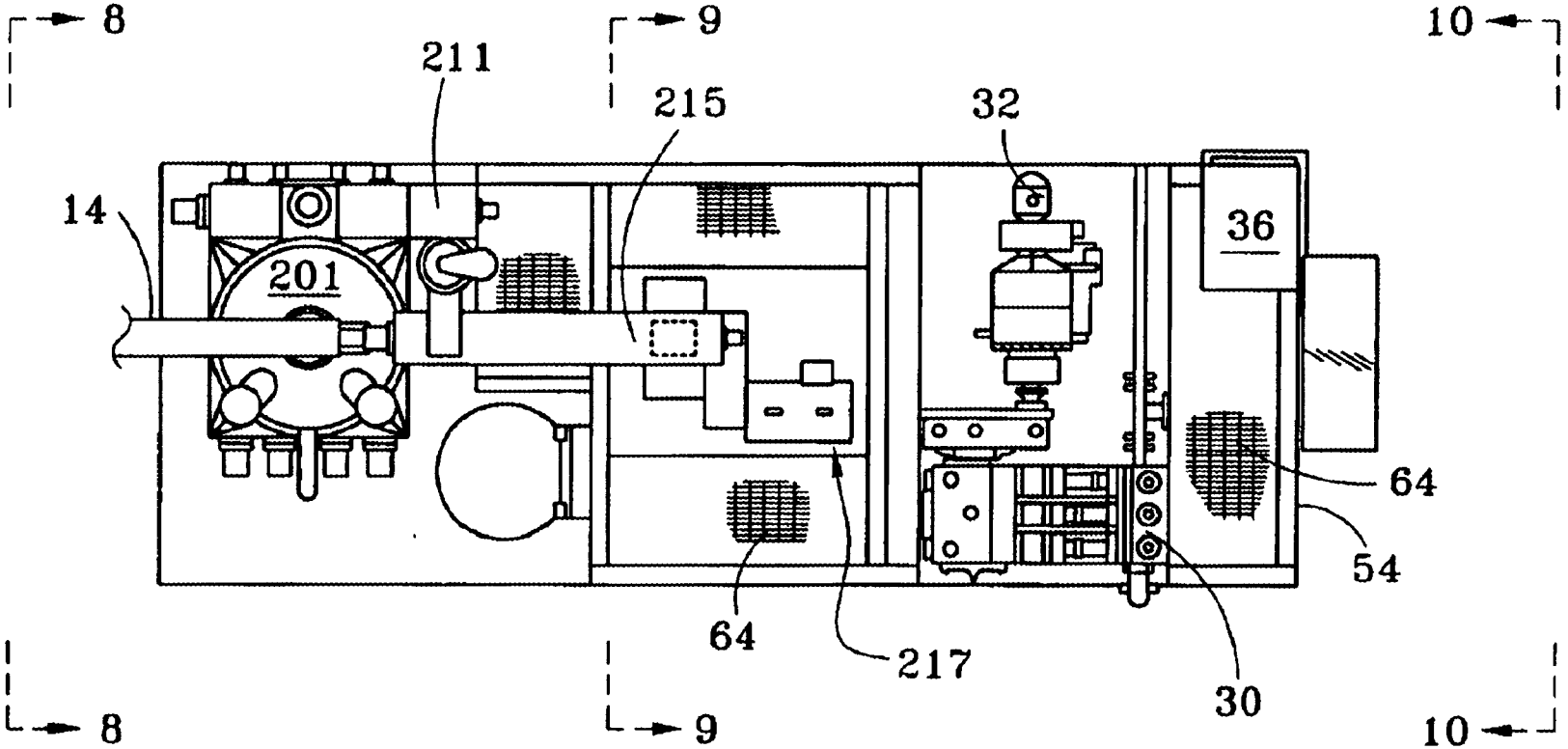
FIG. 7 is a top view of the process module for improved embodiment 2
Figure 9:
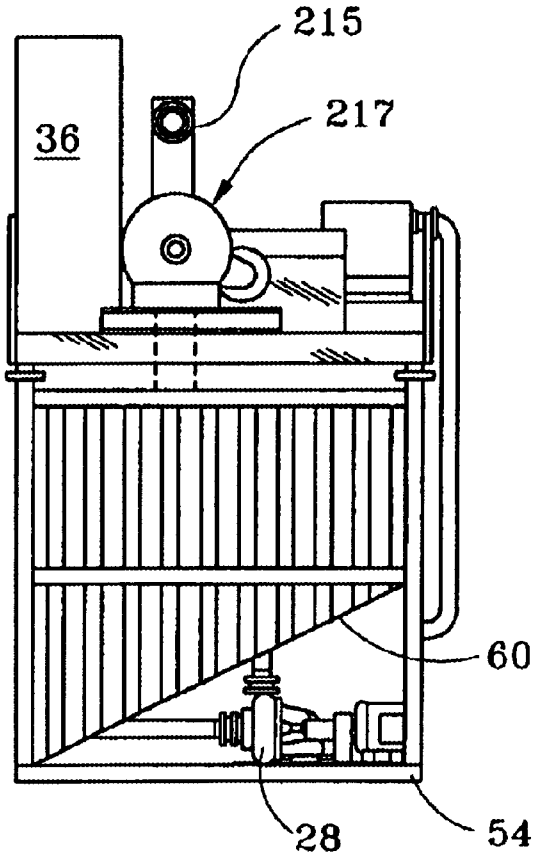
FIG. 9 is a vertical section view of the second embodiment takend along sight line 9—9 seen in FIG. 7.
Figure 8:
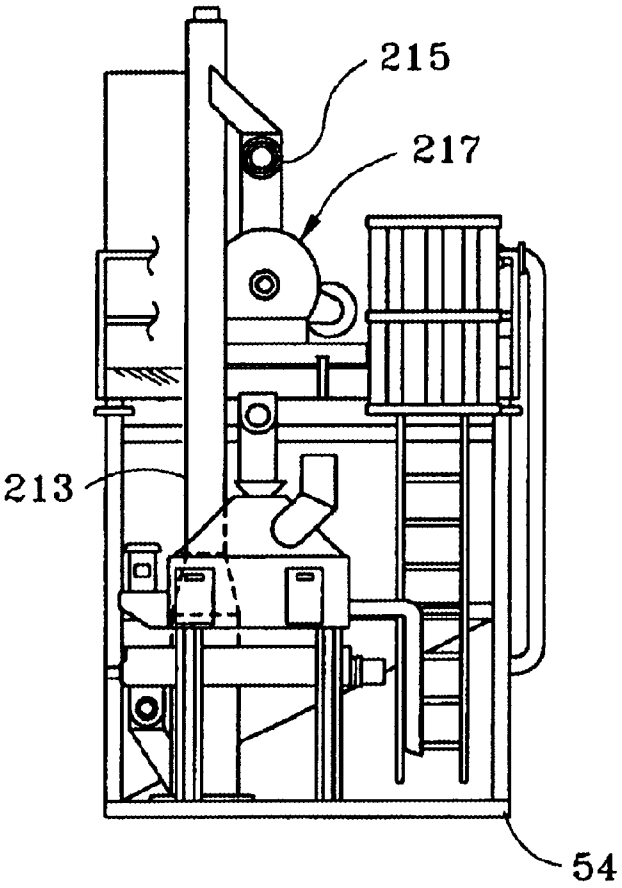
FIG. 8 is a left side elevation view of the process module for improved embodiment 2.
Figure 10:
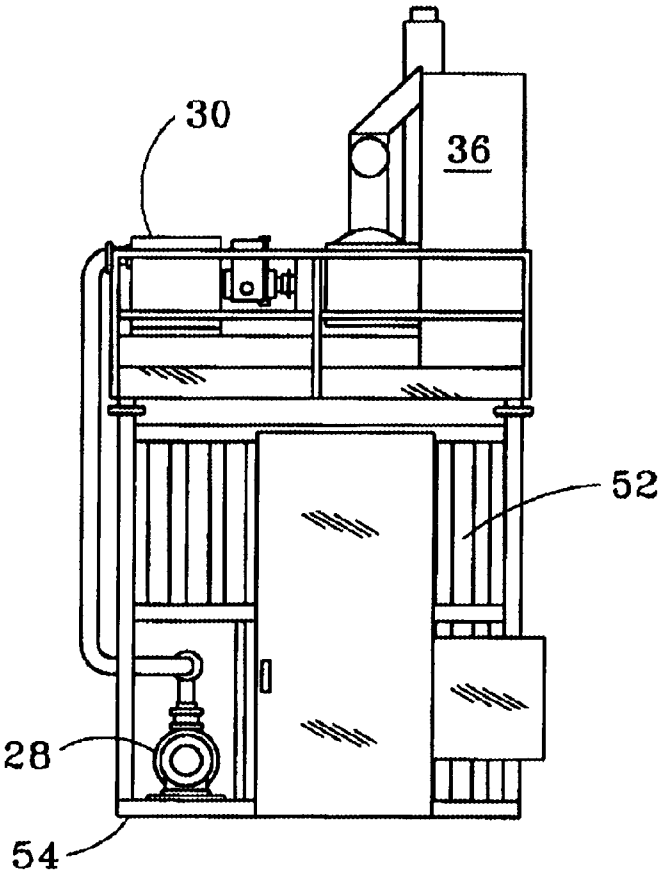
FIG. 10 is a right side elevation view of the process module for improved embodiment 2.
Figure 11:
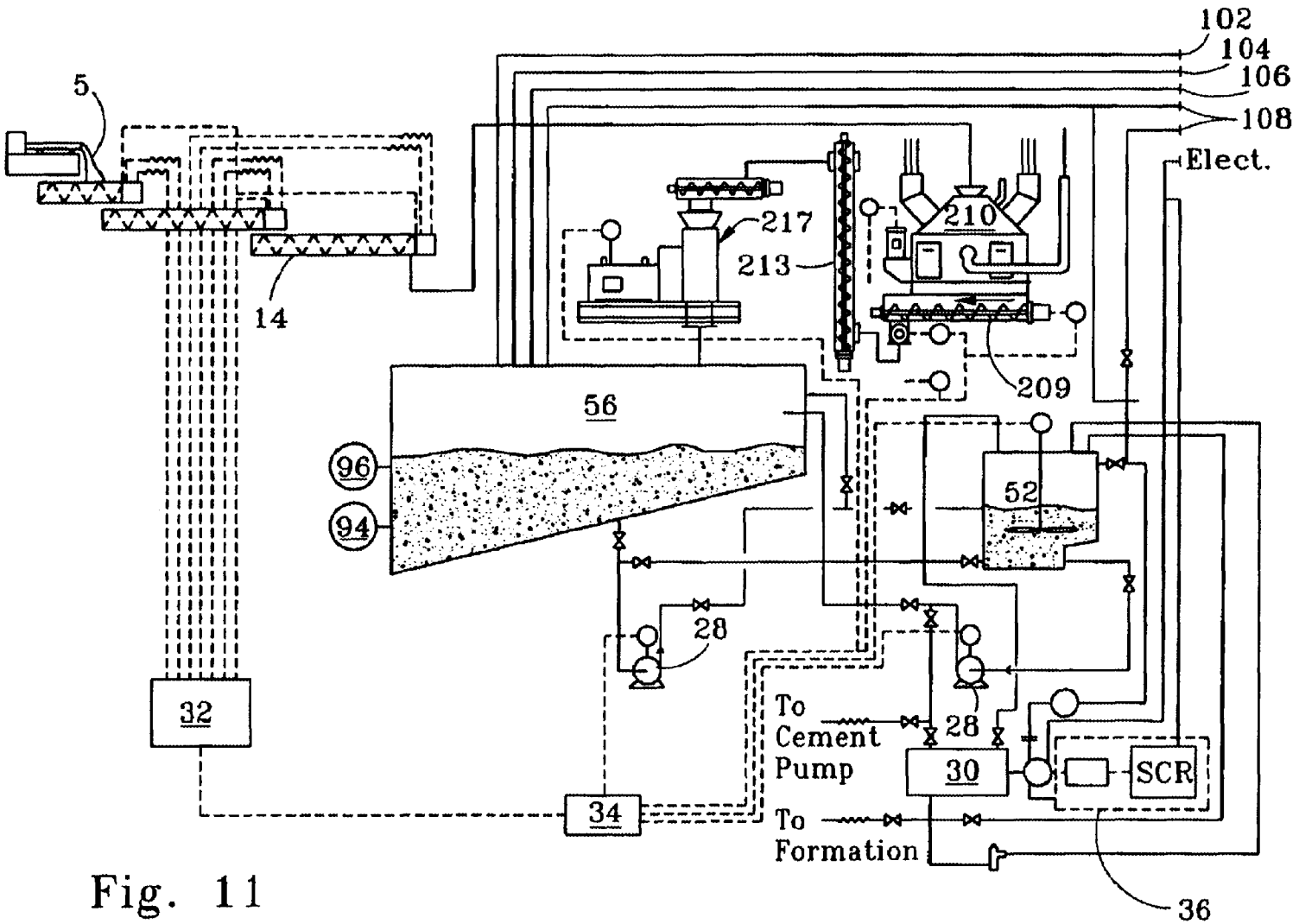
FIG. 11 is schematic diagram of the process module for improved embodiment 2.

The second embodiment as illustrated in FIG. 6 performs the essentially the same function as the first embodiment. However, this arrangement provides a centrifugal drier assembly unit 201 combined with the injection skid 54. As seen here the cuttings are first introduced via conveyer 14 or by some pneumatic means to the centrifugal dryer 201 where the cuttings are spun at high speed with high heat collected from other heat generating equipment on the drilling rig passing through the air inlet and outlet ducts 203,205. Fluids are collected and returned via piping 207 to the rig's drilling fluid recovery system. The dried cuttings are collected in the bottom of the drier and conveyed via conveyors 209–215 or otherwise transferred pneumatically to a particle fine grinder 217, located above the collection tank 56, as also seen in FIG. 7 where the dry cuttings are reduced to a consistent particle size and deposited by gravity feed into the collection tank 56. Since the cuttings are being ground to a consistent particle size prior to entering the tank 56 it is no longer necessary to utilize the grinding pumps 18,19 or the high pressure particle impingement operation located within the tank 56 for this purpose. Grinding Pump 19 may now be replace by a second circulating pump 28. More detail views of the injection module 2 utilizing the dryer and a screw conveying arrangement may be seen in FIGS. 7–10. The dry cuttings are now treated in the single tank 56 in much the same manner as previously done in the primary and secondary slurry tanks 56 and 57 disclosed in our earlier patent. Viewing the schematic in FIG. 11 we see the second embodiment functions basically in the same manner as previously taught with the exception of the addition of the drier 210 and fine grinder 217 prior to discharge into the slurry tank 56. It is important to note that the dried cuttings may be transferred to other locations on the drill site including collection containers etc. for transport when and if the injection process is down for any reason.

As mentioned above the ultimate goal of cuttings disposal by injection is total automation of the injection process. Therefore, enhanced computerization of the system made possible by the programmable SCR system 36 is now the next logical step.

Figure 12:
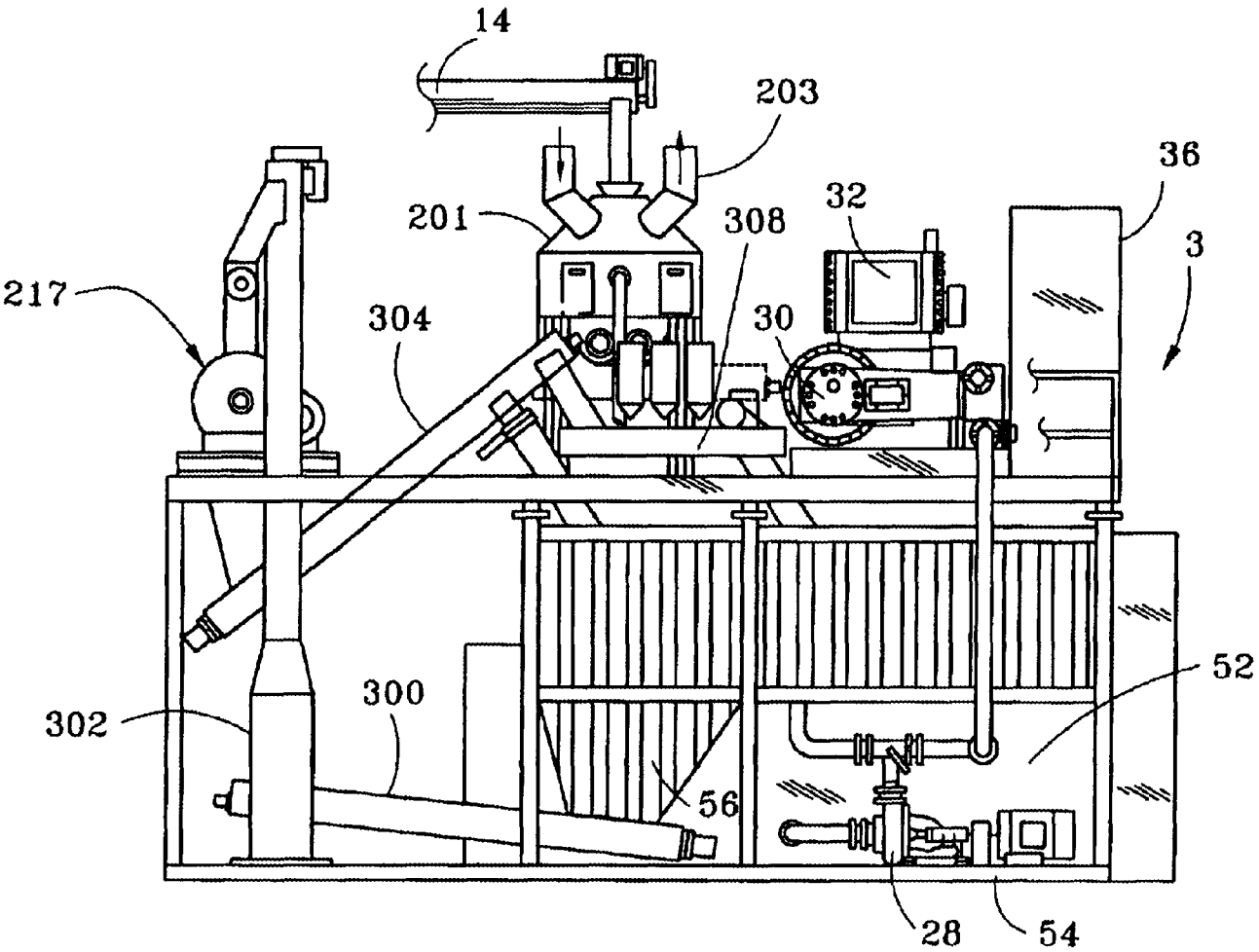
FIG. 12 is a front elevation view of alternative embodiment 3.
Figure 13:
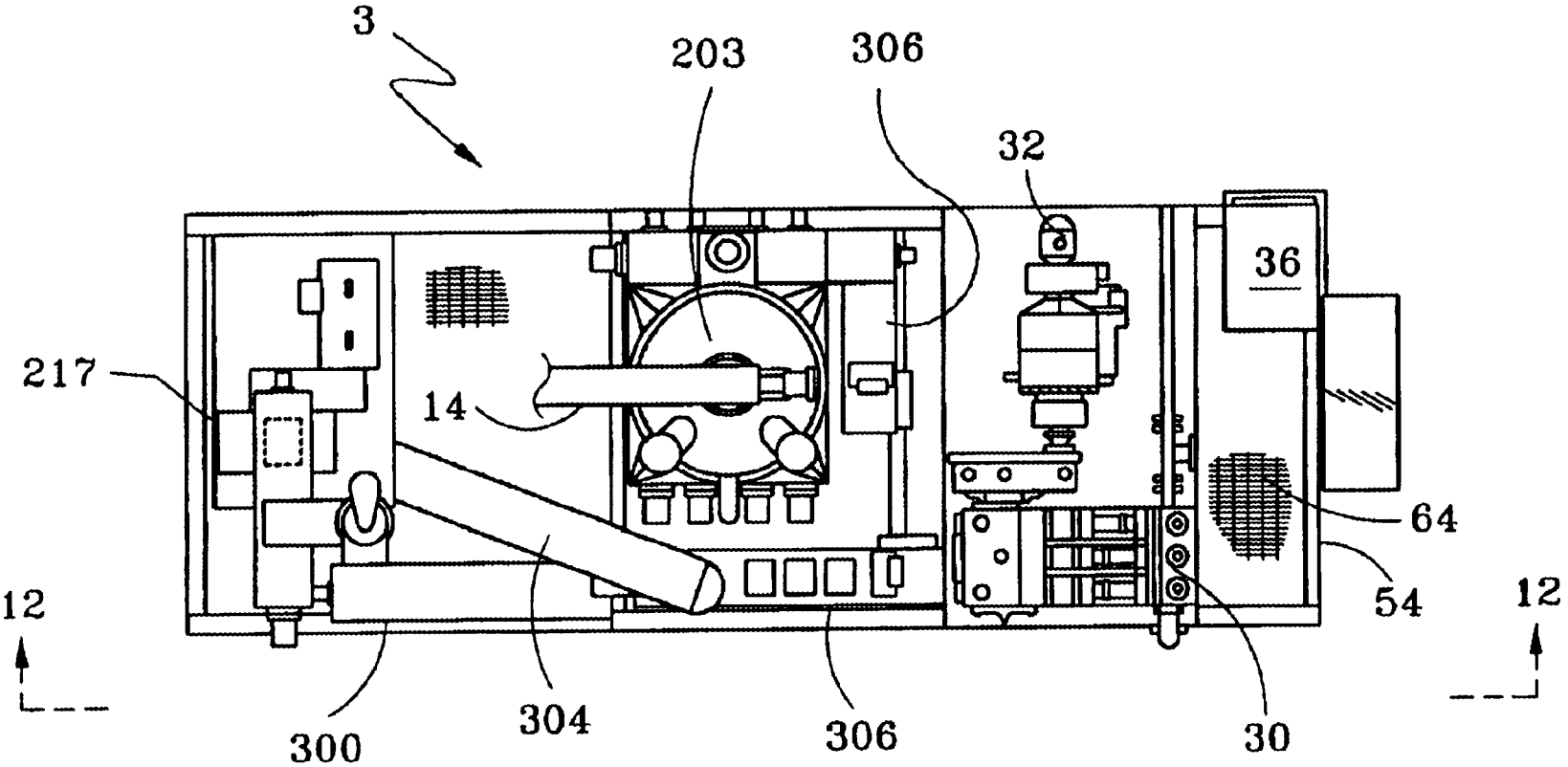
FIG. 13 is a top view of the alternative embodiment 3
Figure 14:
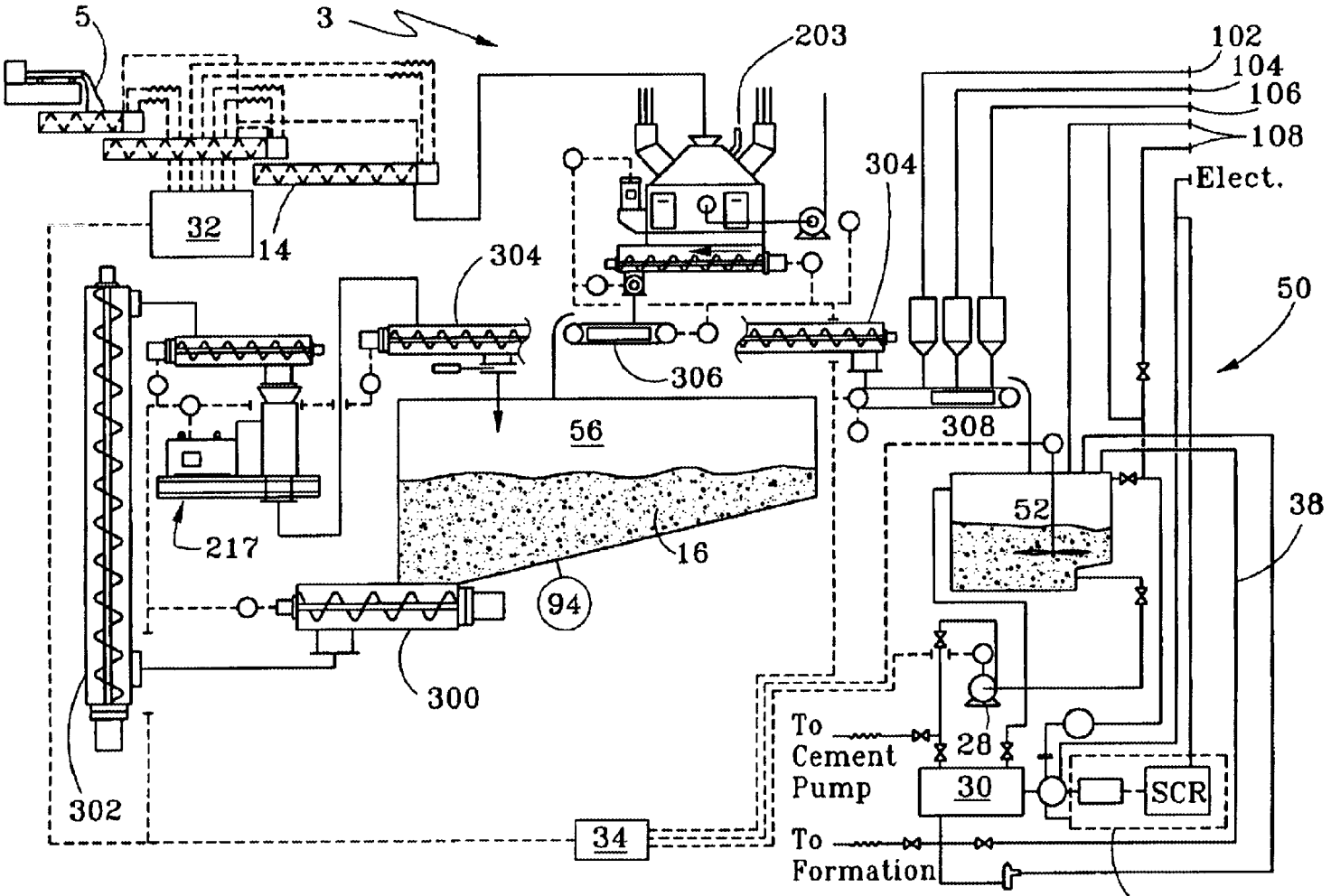
FIG. 14 is a schematic diagram of the process module for alternative embodiment 3.

Looking now at the third embodiment as seen in FIG. 12 we see that by utilizing the centrifugal drying unit 201 located above the dry storage bin 56, cuttings can be transferred pneumatically or via conveyor 14 to the dryer 201. The dried cuttings are then discharged to a weighing station 306 better seen in FIG. 13 thereby providing instant cutting removal flow data to the driller. Several types of weighing stations and batching systems used in other industries may be adapted for use with dried drill cuttings. As illustrated in FIG. 14 the dried cuttings are then discharged into the holding bin 56 now fitted with a live bottom conveyor 300 connected to a vertical conveyer 302 where they are discharged into the fine grinder 217 in the manner disclosed in embodiment 2 above. Dry cuttings 15 discharged from the storage bin 56 may be routed to any collection point on the site for transport and disposal if desired. Cuttings discharged from the fine grinder 217, mill or other particle size reduction equipment, may be optionally routed back to the dry cuttings storage bin 56 via conveyor 304 or other transfer means or directed to a proportioning and weighing system 308 where the dried cuttings are mixed by weight with chemicals as necessary to meet requirements on demand by the formation injection system prior to being introduced into the slurry mixing tank 52.

Figure 15:
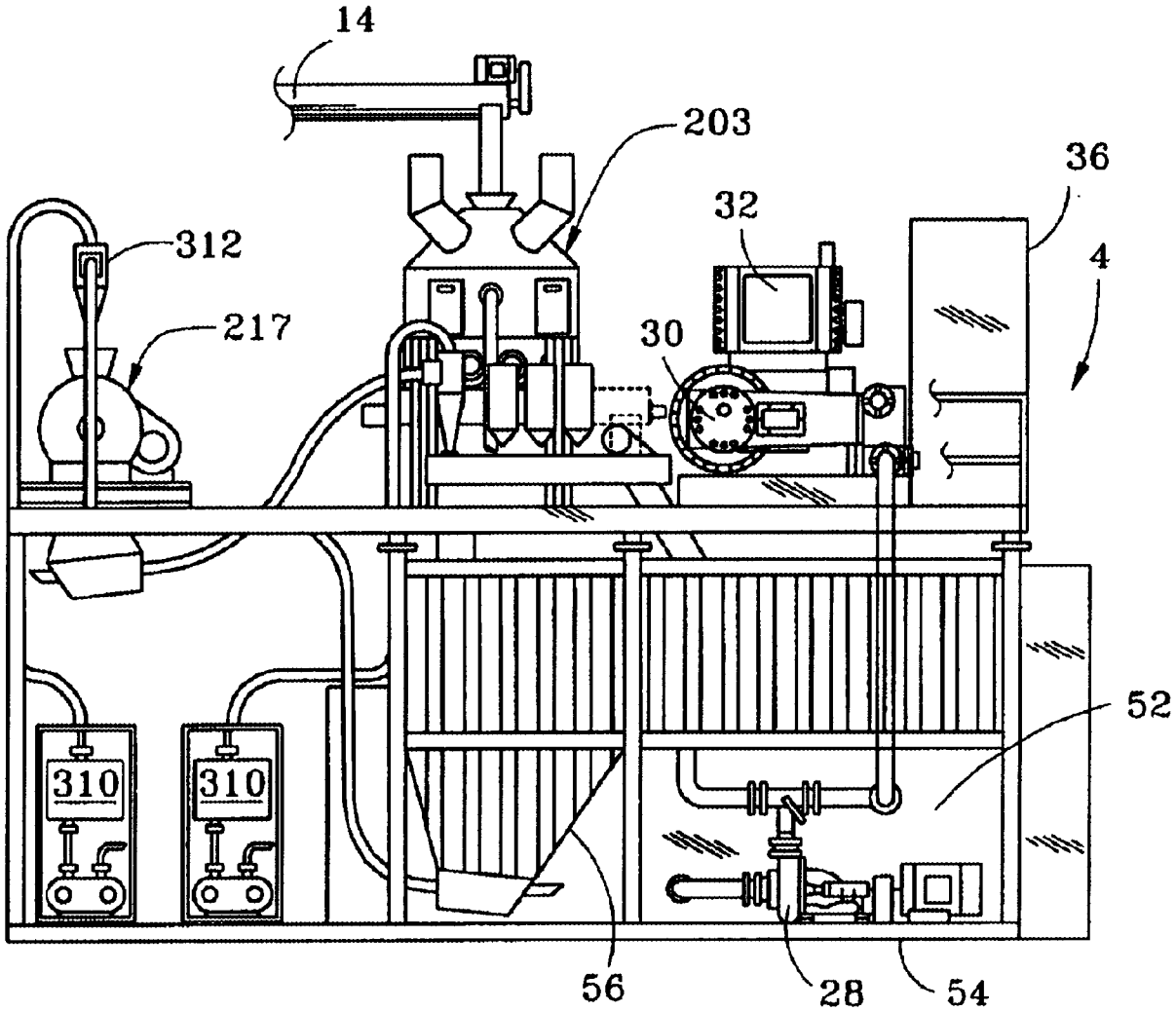
FIG. 15 is a front elevation view of the process module for a $4^{th}$ embodiment.
Figure 16:
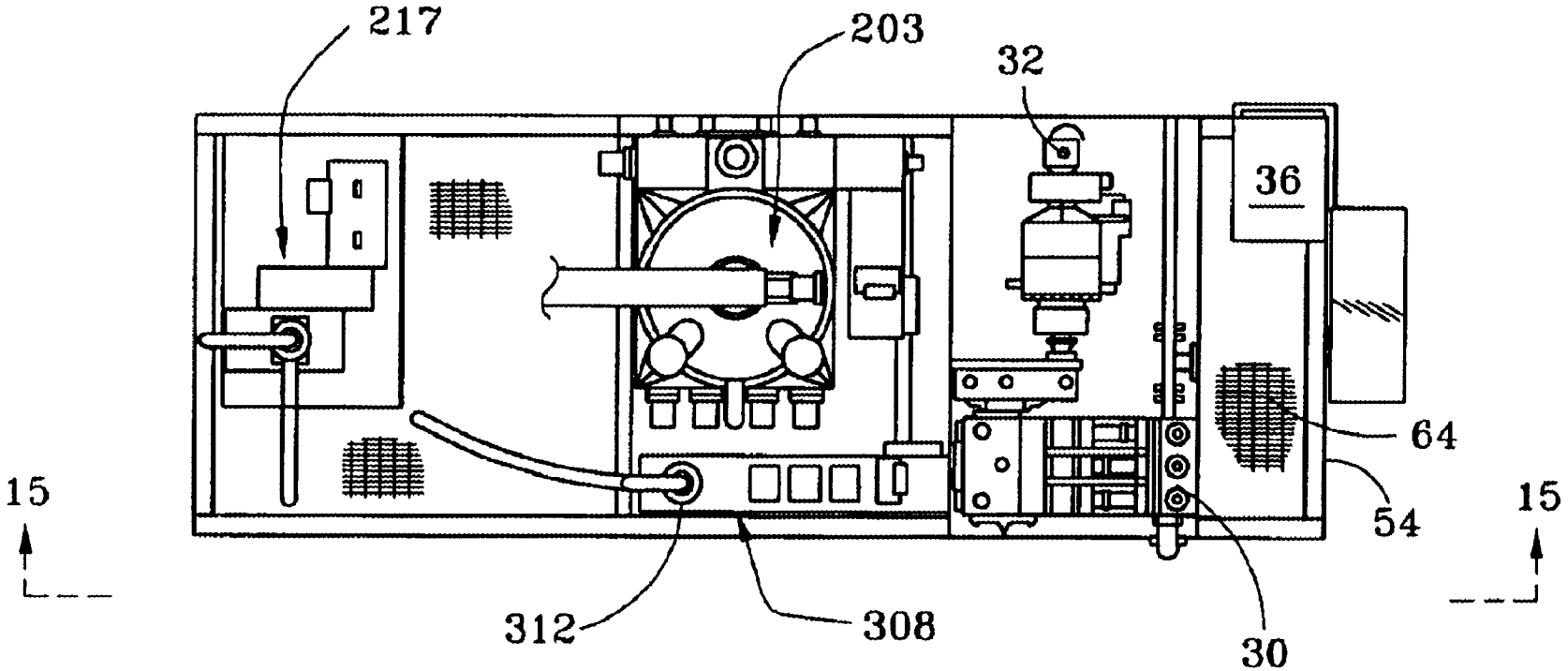
FIG. 16 is a top view of the process module for the $4^{th}$ embodiment.

As mentioned above transfer of the dry cuttings may be more easily accomplished by pneumatics than by conveyers as illustrated in FIG. 15 or better viewed in FIG. 16. In such an arrangement hoses replace the conveyors and vacuum and or pressure pumps 310 and cyclonic dispersion units 312 may be used at each discharge station. Again, the dry cuttings 15 may be transferred in this manner to any collection or discharge station on the site for storage, transport and or disposal.

Figure 17:
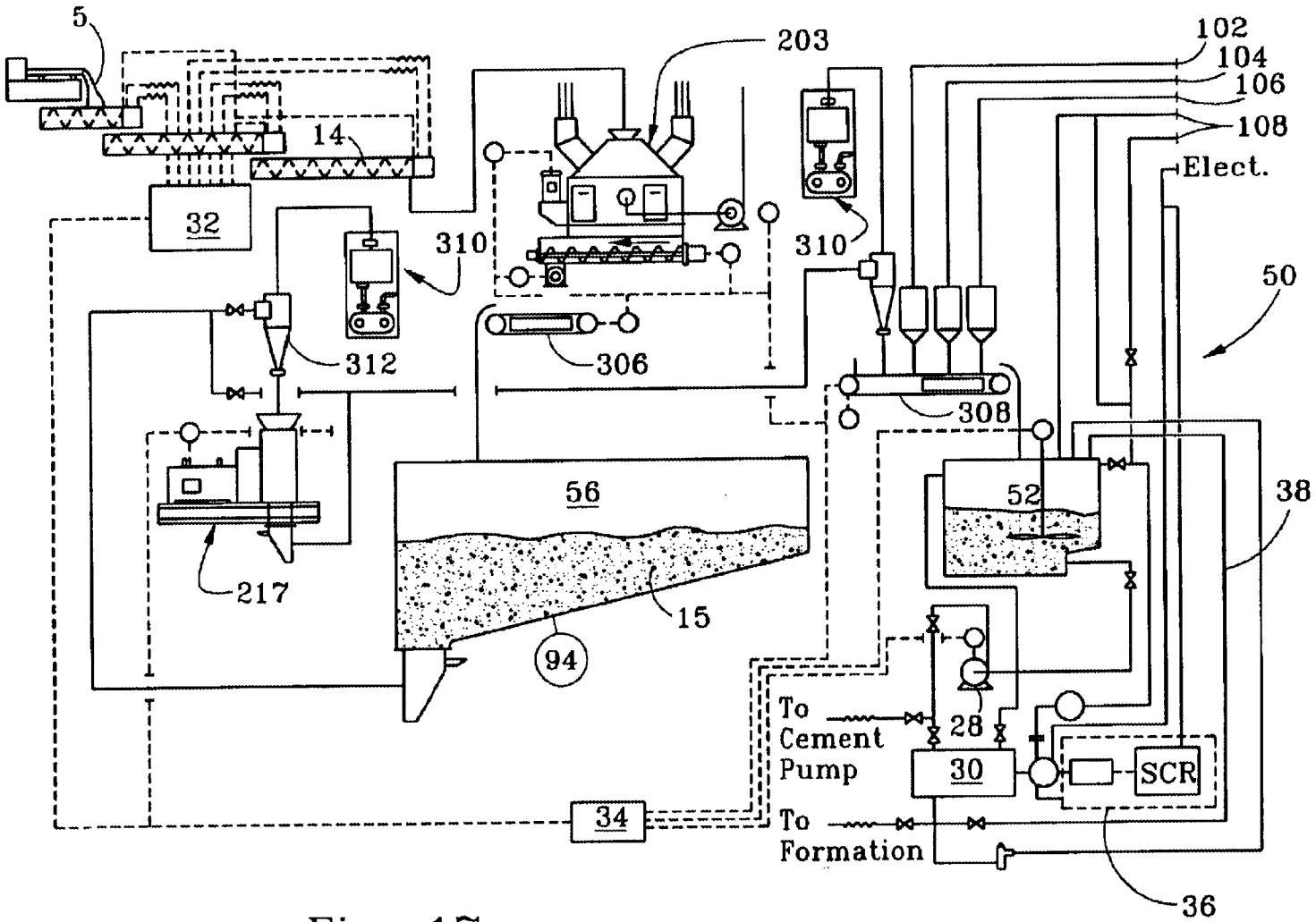
FIG. 17 is a schmatic diagram for the process module for the $4^{th}$ embodiment.

A clear view of a pneumatic system is illustrated schematically in FIG. 17.

Figure 18:
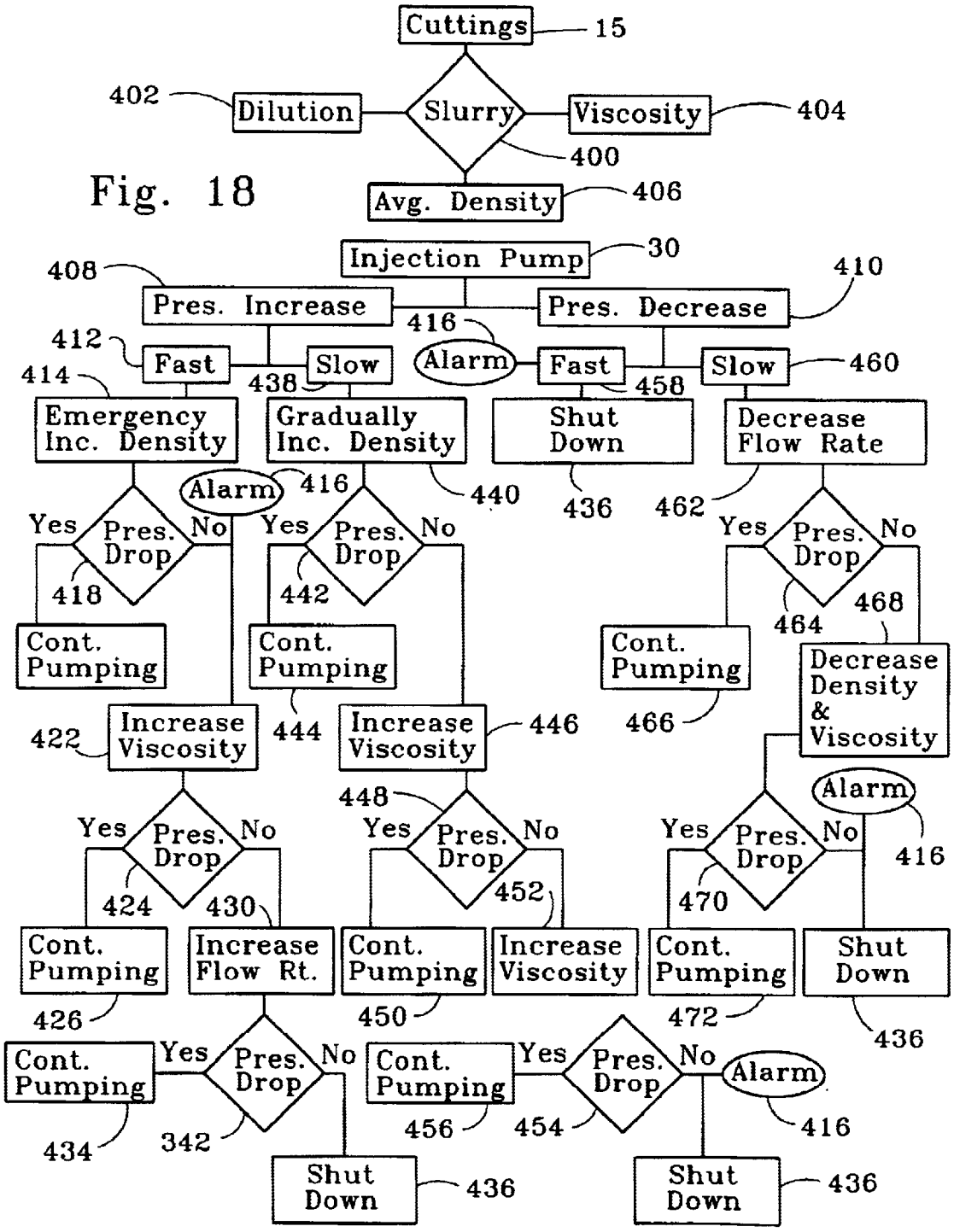
FIG. 18 is a computer process diagram for cuttings injection systems.

Full automation of the injection process is dependent on the a programmed computer program structure as illustrated in FIG. 18. The on board computer system controls the composition of the cuttings slurry 400 by metering the cuttings 15, controlling there density by dilution 402 with water and controlling the viscosity 404 by the aditions of chemicals and thereby maintaining an average density 406 in the slurry tank 52 prior to entering the injection pump 30. By monitoring the injection pump pressure the computer system reacts to changes in system pressure variations at various stages of the down-hole injection process. By comparing these system pressure variations to preprogrammed data in the computer data base derived from past experience and or formation data the average density of the cuttings slurry is automatically adjusted to compensate for pressure variations relative to the formation requirements and thus maximize the cuttings injection process. By sensing the down hole response pressure and automatically correcting for hydrostatic variations by adjusting density and viscosity. Similarly slurry volume and pressure is also computer controlled by varying pump speed therefore, full automatic control of the cuttings injections process is achieved. However, as the formation changes the computer pressure parameters may need to be reprogrammed on site or from a remote location. The on site operator may simply forward the computer historical data to an offsite engineer for analyzes on a periodic basis. The computer pressure parameter limitations may then be reprogrammed as necessary to compensate for formation changes. The computer monitors the cuttings density in the slurry tank and maintains a preset average density by adjusting the weight of the cuttings with water thereby diluting 402 the slurry and or adjusting the viscosity 404 by adding various chemicals. However, the density may be further adjusted on demand from the injections system utilizing the proportioning control system 308. The CPU monitors the response pressures from the injection pump unit and responds to a any rapid increase or decrease in the preset pressure 408 and 409 respectively and treats these extremes as emergency situations and optionally tries to lower the pressure to within the prescribed limits. If the increase peaks to within a prescribed high zone within a preset time the computer system may respond by rapidly increasing the density in an attempt to further fracture the formation if fracture occurs the pressure drops and pumping continues. However, if the pressure continues to increase the system sounds and alarm and increases the viscosity of the slurry in an attempt to make the slurry move more freely through the formation. If pressure drops to within prescribed limits pumping continues 426 if the pressure does not respond flow rate is increased 430 in an attempt to increase pressure an thereby fracture the formation with pressure. If the pressure drops 432 to within prescribed limits pumping continues 434, however if pressure continues to increase the system shuts down 436 the injection pump.

A slow 438 but steady increase in pressure at a prescribed rate results in a gradual increase in density 440. If the pressure drops 442 pumping continues 444. If no change occurs and or fails to drop 442 and the pressure continues to increase the computer responds by increasing viscosity 446. If pressure drops 448 to within the prescribed range pumping continues 450. If the pressure continues to increase the flow rate is increased 452 to increase pressure even higher in an attempt to fracture the formation with pressure. If pressure drops to the prescribed level 454 pumping continues 456 if not an alarm 416 is given and the system shuts down 436.

At this point if the pressure continues to remain in the high zone an alarm is given and shut down 414 occurs if the pressure reaches a critical stage. If the pressure rises rapidly above normal but remains within a low zone the system responds by rapidly increasing the flow rate and increases the density and viscosity 406 thereby increasing pressure in an attempt to fracture the formation to allow expansion for more cuttings materials. This phase is also accompanied by an alarm asking for operator assistance and that shut down 414 may be emanate.

A slow increase in pressure to within the high pressure zone results in a moderate increase adjustment 420 to the flow rate and density. An alarm is also given to indicate that shut down 414 may be emanate.

A slow pressure increase in pressure above normal to within the low zone results that fails to increase to the high zone results in a moderate increase in flow rate, density and viscosity adjustment 422. An alarm is also given to indicate that shut down 414 may be emanate.

A pressure drop may also be an abnormal situation. Both a rapid 228 or slow 230 drop in pressure are treated as emergency situations. A rapid drop in pressure into the high zone results in an automatic shut down 414. This situation may be the result of pipe or pump failure.

A pressure drop into the low zone 432, but remains constant, results in a rapid increase in density, and a rapid increase in flow rate. If the response pressure begins to drop below normal at a slow rate 434 in the low zone the system responds by increasing density and flow rate. If the pressure continues to fall an alarm is given that a shut down 414 is emanate.

Figure 19:
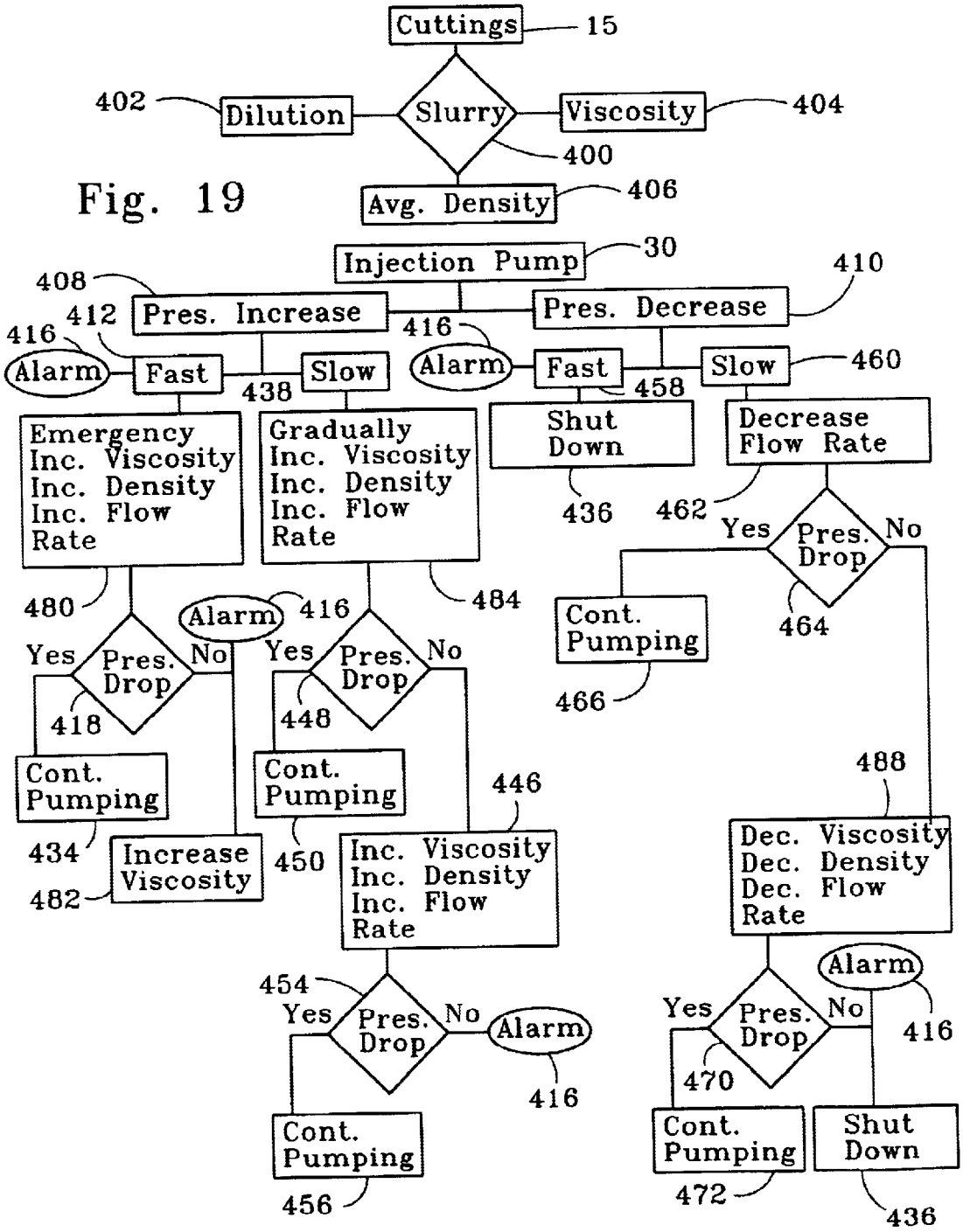
FIG. 19 is an alternative computer process diagram for cuttings injection systems.

A similar scenario exist when injection pressure decreases 410 below a preset level for the particular formation condition at an abnormally fast rate 458 in which case an alarm 416 is given to alear an operator that an abnormal condition exist and the system starts its shut down 436 procedure. However, if the injection pressure decreases below the established minimum pressure for the particular formation at a relatively slow 460 steady rate the computer system automatically decreases the flow rate by controlling the pump speed. If the pressure increases 464 pumping continues 466. If the pressure fails to increase the computer decreases the slurry density 468 and viscosity. If pressure increases 470 pumping continues 472. If pressure does not increase an alarm is given and the system implements its shuts down 436 proceedure. In a second scenario as seen in FIG. 19 the computer may be set in a manner whereby when the pressure increases rapidly 412 an emergency mode 480 is triggered that increases Viscosity, density and flow rate simultaneously. If this procedure fails to drop the pressure to with in the prescribed range the viscosity is again increased 482. The same procedure may be implemented when a slow pressure increase occurs except in this case the viscosity, density and flow rate are increased gradually 484. If the pressure does not fall to acceptable levels the viscosity, density and flow rate is again increased in which case if the pressure drops pumping continues 456 as before. However, if the increases fail to reduce pressure 454 the alarm 416 is given.

The same procedure holds true for a slow decrease in pressure. If a decrease in flow rate 462 fails to increse the pressure they computer may decrease viscosity, density and flow rate simultaneously 488. If this fails to increse the pressure the system initiates its normal alarm and shut down procedure.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. A modular processing and injection system for the injection of drill cuttings, in an earth formation comprising:

a) a drill cuttings receiving tank having a pair of grinding pumps located below and adjacent said receiving tank and grinding pumps having both inlets and outlets connected fluidicly to said receiving tank;

b) a transfer means, a particle sizing means and a lump breaking means located above said receiving tank;

c) a circulating tank having internal agitating means, said circulating tank located adjacent said receiving tank and further includes a circulating pump located below and adjacent to said circulating tank; and d) a computer controlled injection pump located above said circulating tank.

2. The modular processing and injection system according to claim 1 wherein said particle sizing means is a high speed mill.

3. The modular processing and injection system according to claim 1 wherein said particle sizing means includes a high pressure particle impingement means located within said receiving tank.

4. The modular processing and injection system according to claim 1 wherein said injection system further includes means for introducing water for dilution and chemicals for controlling viscosity of said drill cuttings within said receiving tank.

5. A modular processing and injection system for the injection of drill cuttings, in an earth formation comprising:

a) a drill cuttings receiving tank having a circulating pump located below and adjacent said receiving tank, said circulating pump having both inlet and outlet connected fluidicly to said receiving tank;

b) a dry particle sizing means discharging directly into said receiving tank;

c) a drying means having a dry material transfer system connecting said drying means and said dry particle sizing means;

d) a transfer means for collecting and transferring said drill cuttings to said drying means;

e) a circulating tank having internal agitating means, said circulating tank located adjacent said receiving tank and further includes a circulating pump located externally and adjacent to said circulating tank; and f) a computer controlled cuttings injection pump located adjacent said circulating tank.

6. The modular processing and injection system according to claim 5 wherein said dry particle sizing means is a high speed grinder.

7. The modular processing and injection system according to claim 5 wherein said injection system further includes means for introducing water for dilution and chemicals for controlling viscosity of said drill cuttings within said circulating tank.

8. The modular processing and injection system according to claim 7 wherein said means for introducing water for dilution and chemicals for controlling viscosity of said drill cuttings within said circulating tank are each proportion controlled by computer.

9. The modular processing and injection system according to claim 5 wherein said injection system further includes means for weighing said drill cuttings after discharge from said drying means and prior to discharge into said receiving tank.

10. The modular processing and injection system according to claim 9 further comprising a computerized slurry control system said control system further comprising a means for automatically monitoring said means for weighing and maintaining a running record of the weight of said dry cuttings being discharge from said drying means.

11. The modular processing and injection system according to claim 5 wherein said drying means is heated by scavenged heat from other heat generating equipment on a drilling rig.

12. The modular processing and injection system according to claim 5 wherein said transfer means located between said dry material transfer system and said particle sizing means includes pneumatic transfer systems.

13. The modular processing and injection system according to claim 5 further comprising a computerized slurry control system said control system further comprising a means for automatically monitoring and controlling cutting slurry density and viscosity within said circulating tank.

14. The modular processing and injection system according to claim 5 further comprising a computerized slurry control system said control system further comprising a means for automatically monitoring and controlling speed of said injection pump.

15. A process for automating a cuttings injection system comprising the steps of:

a) providing a computer system and programming said computer system to monitor and control cuttings slurry density and viscosity;

b) providing said computer system with programming for establishing average density and viscosity levels to be maintained as a base line for a particular well formation;

c) providing said computer system with programming establishing a preset of high and low pressure parameters exceeding said base line to be automatically maintained by adjusting said slurry density and viscosity;

d) providing said computer system with programming for monitoring and controlling speed of a cuttings injection pump in combination with controlling said slurry density and viscosity; and e) monitoring injection pressure on said cuttings injection pump and adjusting said density, viscosity and pump speed to maintain pressure to within said high and low pressure parameters.

16. The process for automating a cuttings injection system according to claim 15 wherein said system further includes the step of sounding an alarm when said pressure parameters are exceeded.

17. The process for automating a cuttings injection system according to claim 15 wherein said system further includes the step of shutting down said injection pump when said pressure parameters are exceeded.

18. The process for automating a cuttings injection system according to claim 15 wherein said system further includes the step of reprogramming said computer system as necessary when significant well formation variations occur.

19. The process for automating a cuttings injection system according to claim 15 wherein said system further includes the step of adjusting said cuttings density, viscosity and pump speed sequentially as necessary to maintain said injection pressure parameters.

20. The process for automating a cuttings injection system according to claim 15 wherein said system further includes the step of adjusting said cuttings density, viscosity and pump speed simultaneously as necessary to maintain said injection pressure parameters.

21. The process for automating a cuttings injection system according to claim 15 wherein said system further includes the step of utilizing said cuttings density, viscosity and pump speed to fracture said well formation.

22. A modular processing and injection system for the injection of drill cuttings in an earth formation, comprising:

a) a module for reducing the size of drill cuttings;

b) a device for placement of reduced-size drill cuttings into slurry; and c) an injection pump for receiving drill cuttings from the drill cuttings receiving tank and injecting a slurry of said cuttings into an earth formation under controlled conditions of density, viscosity and pump speed.

23. The modular processing and injection system according to claim 22 further comprising a computer associated with the injection pump for control of conditions of density, viscosity and pump speed.

24. The modular processing and injection system according to claim 22 wherein the device for placement of reduced size drill cuttings into slurry comprises a grinding pump operably associated with a drill cuttings receiving tank.

25. The modular processing and injection system according to claim 22 wherein the device for placement of reduced size drill cuttings into slurry comprises a slurry mixing tank.

26. The modular processing and injection system according to claim 22 wherein the module for reducing the size of drill cuttings comprises a particle impingement device.

27. The modular processing and injection system according to claim 22 wherein the module for reducing the size of drill cuttings comprises a roll mill.

28. The modular processing and injection system according to claim 22 wherein the module for reducing the size of drill cutting comprises a fine grinder.

29. A modular processing and injection system for the injection of drill cuttings into an earth formation, comprising:

a) a drill cuttings receiving tank having a particle impingement device for reducing the size of cuttings entering the drill cuttings receiving tank;

b) at least one grinding pump operably associated with the receiving tank for placement of drill cuttings into slurry; and c) an injection pump for injecting a slurry of said cuttings into an earth formation under controlled conditions of density, viscosity and pump speed.

30. The modular processing and injection system according to claim 29 further comprising a circulating tank and circulating pump operably interconnected with the circulating tank.

31. The modular processing and injection system according to claim 29 further comprising a roll mill for reducing the size of drill cuttings entering the drill cuttings receiving tank.

* * * * *